United States Patent [19]

Bass

[11] 4,341,288

[45] Jul. 27, 1982

[54] ELEVATOR SYSTEM

[75] Inventor: Jerry D. Bass, Martinez, Calif.

[73] Assignee: Westinghouse Electric Corp., Pittsburgh, Pa.

[21] Appl. No.: 232,287

[22] Filed: Feb. 6, 1981

[51] Int. Cl.[3] ..... B66B 1/16

[52] U.S. Cl. ..... 187/29 R; 340/20

[58] Field of Search ..... 187/29; 307/113; 340/19, 20, 825.61

[56] References Cited

U.S. PATENT DOCUMENTS

| | | | |
|---|---|---|---|
| 3,388,376 | 6/1968 | Magee | 187/29 |
| 4,026,389 | 5/1977 | Magee | 187/29 |
| 4,157,133 | 6/1979 | Corcoran et al. | 187/29 |
| 4,298,100 | 11/1981 | Süss et al. | 187/29 |

FOREIGN PATENT DOCUMENTS

| | | | |
|---|---|---|---|
| 52-18652 | 2/1977 | Japan | 187/29 |
| 52-27151 | 3/1977 | Japan | 187/29 |
| 52-33237 | 3/1977 | Japan | 187/29 |
| 52-44937 | 4/1977 | Japan | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system having a security terminal which enables predetermined floors in response to predetermined security inputs. The security terminal, in response to an authorized input, issues a floor enabling signal to a selected elevator car. Timely registration of a car call in the selected car for the enabled floor latches the enablement for the duration of the run.

11 Claims, 6 Drawing Figures

| S4S | S3S | S2S | S1S | S0S |
|---|---|---|---|---|
| 0 | 0 | 0 | 0 | 0 |
| 0 | 0 | 0 | 0 | 1 |
| 0 | 0 | 0 | 1 | 0 |
| 0 | 0 | 0 | 1 | 1 |
| 0 | 0 | 1 | 0 | 0 |
| 0 | 0 | 1 | 0 | 1 |
| 0 | 0 | 1 | 1 | 0 |
| 0 | 0 | 1 | 1 | 1 |
| 0 | 1 | 0 | 0 | 0 |
| 0 | 1 | 0 | 0 | 1 |
| 0 | 1 | 0 | 1 | 0 |
| 0 | 1 | 0 | 1 | 1 |
| 0 | 1 | 1 | 0 | 0 |
| 0 | 1 | 1 | 0 | 1 |
| 0 | 1 | 1 | 1 | 0 |
| 0 | 1 | 1 | 1 | 1 |
| 1 | 0 | 0 | 0 | 0 |
| 1 | 0 | 0 | 0 | 1 |
| 1 | 0 | 0 | 1 | 0 |
| 1 | 0 | 0 | 1 | 1 |
| 1 | 0 | 1 | 0 | 0 |
| 1 | 0 | 1 | 0 | 1 |
| 1 | 0 | 1 | 1 | 0 |
| 1 | 0 | 1 | 1 | 1 |
| 1 | 1 | 0 | 0 | 0 |
| 1 | 1 | 0 | 0 | 1 |
| 1 | 1 | 0 | 1 | 0 |
| 1 | 1 | 0 | 1 | 1 |
| 1 | 1 | 1 | 0 | 0 |
| 1 | 1 | 1 | 0 | 1 |
| 1 | 1 | 1 | 1 | 0 |
| 1 | 1 | 1 | 1 | 1 |
| 0 | 0 | 0 | 0 | 0 |
| 0 | 0 | 0 | 0 | 1 |

ELEVATOR SYSTEM

BACKGROUND OF THE INVENTION

1. Field of the Invention

The invention relates in general to elevator systems, and more specifically to elevator systems which include an access control system or security terminal.

2. Description of the Prior Art

It is common in elevator systems to select at least one elevator car from a bank of cars to operate in a night-time security mode. Still other elevator systems may operate in a security mode at all times, for all floors, or for certain specified floors, depending upon the building and its usage. In such systems, a suitable access control system or security terminal is usually located at the main floor or lobby of the associated building, which operates in conjunction with the supervisory control or system processor of the elevator system. When the elevator system is placed on security mode, a prospective passenger must provide a predetermined security input to this access control system.in order to gain access to at least certain of the floors displaced from the main or lobby floor. Upon recognizing a proper security input, the security terminal causes the supervisory control or system processor for the elevator system to enable a certain floor, or floors, that the individual is authorized to gain access to. In order to provide prompt service to the next prospective passenger, the supervisory control system must then monitor the call serving process, starting with the placement of the car call by the individual for an enabled floor, and ending with the completion of service to the enabled floor. If the building has certain floors which operate continuously in security mode, and others which do not, continuous monitoring of the security calls adds substantially to the complexity and cost of the elevator system, and it increases the running time of the group supervisory program for an elevator system processor which is computer controlled. Merely enabling the selected floor for a predetermined period of time is inefficient, as the time must be selected for the maximum run. On shorter runs, the security car will sit idle until its time expires, delaying service to the next passenger. If the car is delayed by the passenger holding the doors, etc., the floor enable time may expire before the car even reaches the destination floor.

Thus, it would be desirable to provide a new and improved access control system for elevators which may be quickly and easily applied to new, or existing elevator systems. The system should have a low initial cost, and it should place little additional burden on the group supervisory control or system processor of the elevator system, facilitating use of the system in buildings which have security controlled floors during the normal working day, as well as in buildings which use the security mode only after normal hours, and on weekends.

SUMMARY OF THE INVENTION

Briefly, the present invention is a new and improved elevator system having a security terminal. The security terminal recognizes security inputs by prospective passengers, to enable a floor, or floors, for which they are authorized. The security function includes two steps arranged to remove a supervisory burden from the elevator system processor, and at the same time assure that a call for an enabled floor is satisfactorily completed, and provide prompt service to the next user. The first step, performed by the security terminal and system processor by cooperative effort is the issuance of a first enablement signal, which indicates the enabled floor. The second step is performed by a memory associated with the selected elevator car which "memorizes" the first enablement signal by providing a similar second enablement signal in response to the registration of a timely car call. The second enablement signal persists without any supervision from the system processor until the call has been served. Completion of the service to the enabled floor automatically resets or terminates the second enablement signal, enabling the car to be directed to immediately serve the next authorized call. If more than one car can serve security calls, the system processor is free to assign a subsequent security call to another car, as soon as it completes the assigning process for the previous security call.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

Figure 1:
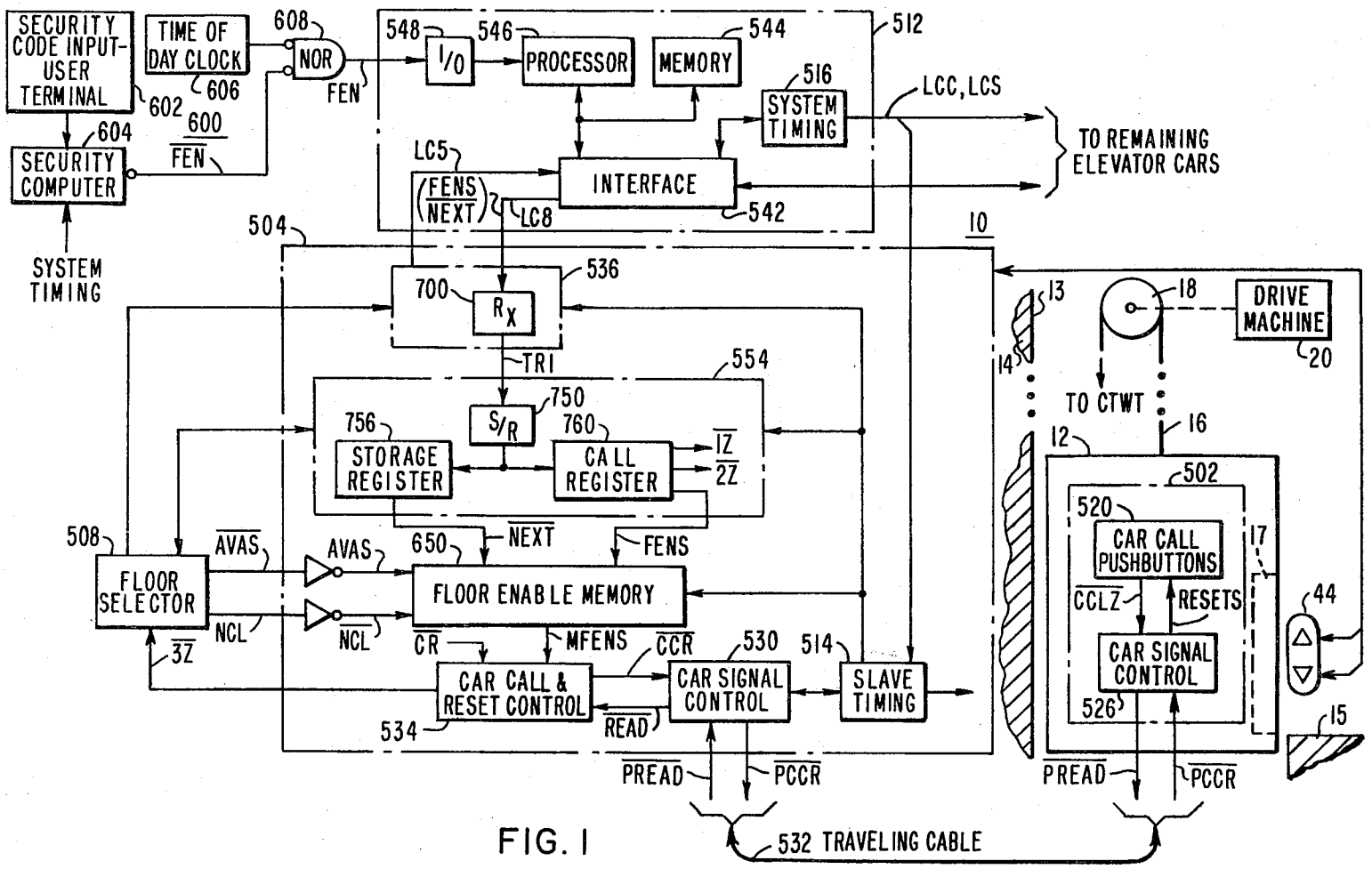
FIG. 1 is a diagrammatic view of an elevator system constructed according to the teachings of the invention.

Referring now to the drawings, and to FIG. 1 in particular, there is shown an elevator system 10 which is constructed according to the teachings of the invention. In order to simplify the application, it will be assumed that the elevator system 10 is the system which is collectively described in detail in U.S. Pat. Nos. 3,750,850; 3,804,209 and 3,851,733, which are assigned to the same assignee as the present application. These U.S. patents are hereby incorporated into the present application by reference. The '850 patent sets forth operative control specific to each elevator car, the '209 patent sets forth additions and modifications of the car control shown in the '850 patent which enables the cars to be operated under group supervisory control, and the '733 patent sets forth suitable group operating strategy for the system processor of the elevator system which directs a plurality of elevator cars to efficiently serve calls for elevator service in a building.

FIG. 1 is similar to FIG. 11 of the incorporated '209 patent, with the functions in FIG. 1 which are the same as those in FIG. 11 being given the same reference numerals.

Elevator system 10 includes one or more elevator cars, such as car 12. For purposes of example, it will be assumed that the elevator system 10 includes a plurality of cars which are under group supervisory control, such as by a system processor 512. Since each of the cars of the bank of cars, and the controls therefor, are similar in construction and operation, only the controls for car 12 are illustrated.

More specifically, car 12 is mounted in a hatchway 13 for movement relative to a structure 14 having a plurality of landings, with only one of the landings, referenced 15, being shown in order to simplify the drawing. The car is supported by a plurality of wire ropes 16 which are reeved over a traction sheave 18 mounted on the shaft of a drive motor 20, such as a direct current motor as used in the Ward-Leonard drive system, or in a solid state drive system. A counterweight (not shown) is connected to the other ends of the ropes 16. Car 12 includes car doors 17 operable between opened and closed positions by a suitable door operator mechanism. The car doors operate hatch doors located at each floor, to open and close an entranceway to the interior of the elevator car from each floor.

The controls for elevator car 12 includc a car station 502 mounted in the elevator car, and a car controller 504, which is usually mounted in the machine room, with the two control functions being interconnected via a traveling cable 532.

Car calls, as registered by pushbuttons 520 mounted in the elevator car 12, are recorded and serialized in the car station 502, and the resulting serialized car call information is sent to the car controller 504 and then to a floor selector 508. Hall calls, as registered by pushbuttons mounted in the hallways associated with each floor, such as the up and down pushbuttons 44 associated with floor 15, are directed to hall call control which is part of the car controller 504, and then to the system processor.

Figure 2:
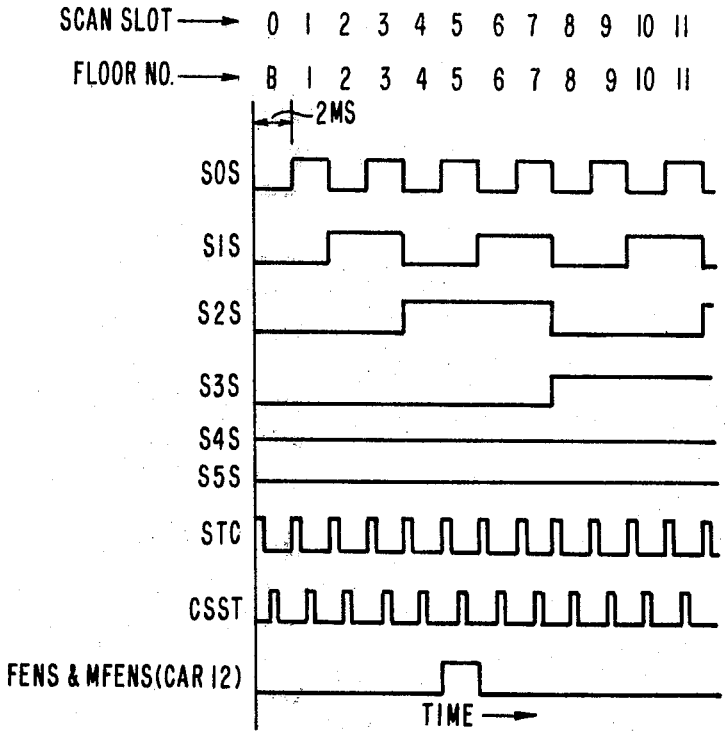
FIG. 2 is a graph setting forth certain timing and signal waveforms useful in understanding the operation of the invention.

The processor 536 of the system processor 512 is a digital computer in the preferred embodiment of the elevator system 10 described in the incorporated applications, and thus the system is a serial system. FIG. 2 illustrates some of the serial timing waveforms used to properly sequence the car controller 504 and the car station 502, as well as to control the flow of data to and from the system processor 512.

Hall and car call information pertaining to different floors of the building 14 to be served by the elevator system 10 is monitored sequentially in time. Each floor of the building is assigned a specific count of a scan counter, such as a binary counter, located in each car controller, referred to as slave timing 514. The outputs of this scan counter, which may be pulsed every two milliseconds, for example, are referred to as S0S through S5S in FIG. 2. Thus, this six-bit counter repetitively divides successive predetermined time intervals into a plurality of scan or time slots before resetting to zeros, to divide the next period of time into scan slots. Each floor thus has a specific scan slot which has a specific binary address set forth by S0S-S5S, but each scan slot does not necessarily designate a floor level. For example, some scan slots may be used to indicate when a car is in an express zone. Depending upon the number of floors and the number of scan slots used for other purposes, the scan counter will be programmed to provide sixteen, thirty-two, sixty-four or one hundred twenty-eight scan slots, before returning the count to zeros.

The scan counters in the various car controllers are maintained in synchronism by a master scan counter, indicated by the master timing block 516 in the system processor 512, which provides master clock and sync signals LCC and LCS, respectively, for each car controller.

Signal STC in FIG. 2 is a timing strobe which is true for a short time at the start of each scan slot, and signal CSST is a car call strobe used to strobe car calls from a multiplexed signal $\overline{\text{READ}}$, which is sent from the car station 502 to the car controller 504 as signal $\overline{\text{PREAD}}$, to indicate the higher voltage level required for traveling cable transmission. Signals FENS and MFENS are first and second floor enable signals, which will be hereinafter described in detail.

Figure 3:
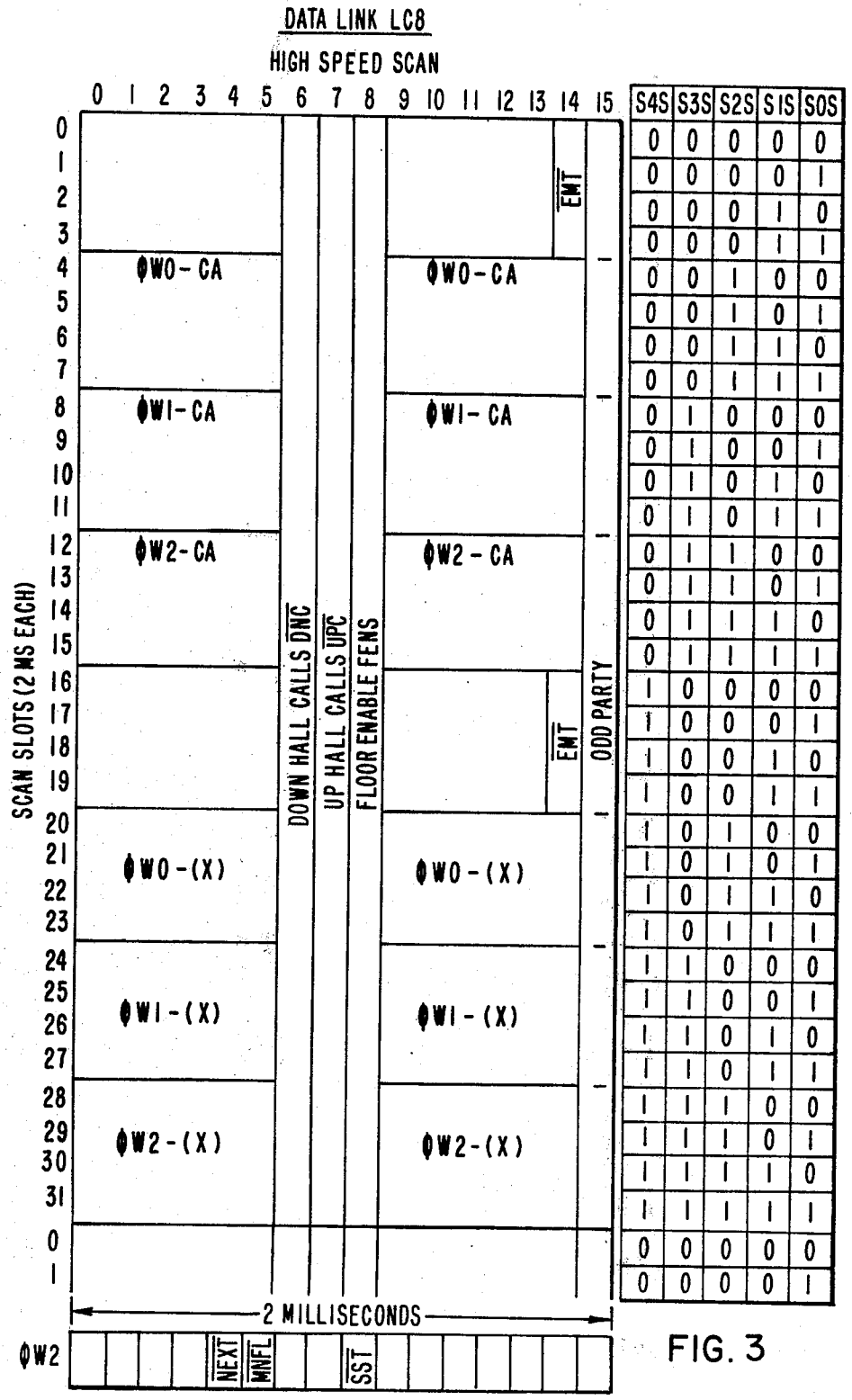
FIG. 3 is a data format or signal map which sets forth the information sent in data link LC8 shown in FIG. 1.

Data link LC8, which communicates information from the system processor 512 to the car controller 502, is shown in FIG. 22 of the incorporated '209 patent, has portions thereof reproduced and set forth in FIG. 3 of the present application. Data link LC8, as shown in FIG. 3, illustrates the basic scan slots vertically along the lefthand side, and the binary address of each scan slot, as developed by the scan counter output, is shown on the righthand side. A subdivision of the basic scan slots is shown horizontally under the heading "high speed scan."

For purposes of example, it will be assumed that each of the basic scan slots exists for 2 milliseconds, which provides a data transmission rate over the traveling cable of 500 hz. Each basic scan slot is divided into sixteen bits by the high speed scan, transmitting monitoring and command data between the system processor 512 and the car controllers at a rate of 8 khz. When the scan counter is outputting the binary address of a specific floor, a car call for that specific floor will appear in that basic scan slot. During the same address of the specific floor, the high speed scan will output a plurality of bits of information relative to the same floor. Thus, when the scan counter is outputting the binary address of the fifth floor, data concerning the fifth floor is transmitted over both the low speed and high speed multiplexed links. Down hall calls $\overline{\text{DNC}}$, up hall calls $\overline{\text{UPC}}$ and the floor enable signal FENS for the various floors may appear in high speed bit positions 6, 7 and 8, respectively, of each basic scan slot.

Basic scan slots 0 through 3 may include traffic director station information, as well as the signal $\overline{\text{EMT}}$ which places the cars on independent control when true, free of the system processor 512.

Basic scan slots 4 through 15 may include the status and command signal from the system processor 512, which may be grouped into three output words called OW0, OW1 and OW2. The output word for each car is identified with the letter C and the car letter. For example, the first output word for car A is identified as OW0-CA.

The first output word OW0 may include such signals as $\overline{\text{PARK}}$ (parking command for the address floor), MOD0 and MOD1 (floor address mode signals), TASS (travel assignment), SASS (service assignment), and floor address signals FAD0 through FAD6.

The second output word OW1 may include such signals as $\overline{\text{BSMT}}$ (basement assignment), $\overline{\text{MCCR}}$ (master call reset), $\overline{\text{CCAI}}$ (car call answer inhibit), $\overline{\text{DOPN}}$ (open door command), $\overline{\text{DCLO}}$ (close door command), and HLM0 and HLM1 (hall lantern mode signals).

The third output word OW2 may include such signals as $\overline{\text{NEXT}}$ (car next), $\overline{\text{MNFL}}$ (advanced car position at the main floor), and $\overline{\text{STT}}$ (special service).

The present invention includes a floor access control system 600, shown in FIG. 1, which receives security input information from prospective elevator passengers. The access control system 600 indicates to the system processor 512 when a security input is authorized, and which floor, or floors, should be enabled. The floor access control system may be operative at all times for all, or selected, floors of a building, or it may be operative in an off-hours mode, such as a night-time and weekend mode. Further, one car of a bank of cars may be preselected to answer security related calls, or more than one, or all cars, may be used, depending upon the amount of traffic to be handled.

Access control system 600 includes a suitable user terminal 602 for receiving suitable security code inputs. For example, terminal 602 may be an optical key reader which detects a code pattern on a key unit placed in its vicinity, it may detect a magnetic code on a key unit, it may be a voice recognition unit, it may be a keyboard for receiving an input code, or the like. Regardless of the type of input terminal, the detected input is compared with predetermined code stored in the reading terminal, or in a security computer 604. Security computer 604 may be dedicated microprocessor, or a general purpose computer which checks and handles all of the security aspects of the building, such as fire and smoke alarms, the positions of doors, etc. When a security input is detected, the security computer 604 looks for a match. If a match is found, a lookup table will be accessed to determine the specific floor, or floors, which should be enabled. The output of the access system 600 to the system processor 512 may be in parallel, connected to input ports which are periodically scanned, or scanned in response to an interrupt generated by the security system. Or, the system timing of the elevator system 10 may be connected to the security computer 604 and a floor enable signal FEN generated directly in serial form therefrom, with an enabled floor appearing as a set bit when the associated floor address is provided by count S0S-S5S.

If the floor access system 600 is to be operated at night, or otherwise by clock, a time of day clock 606 may provide a low output when the security access system is to operate, the outputs of clock 606 and security computer 604 being applied to the inputs of a NOR gate 608. When NOR gate 608 is enabled by clock 606, each true FEN signal in the form of a logic zero applied to its other input will provide a logic one or true floor enable signal FEN at its output. The security computer 604 may generate an interrupt when it is ready to transmit data, and when the system processor 502 is ready to receive the data, computer 604 will output the information into the memory 544 of the system processor 512.

Figure 4:
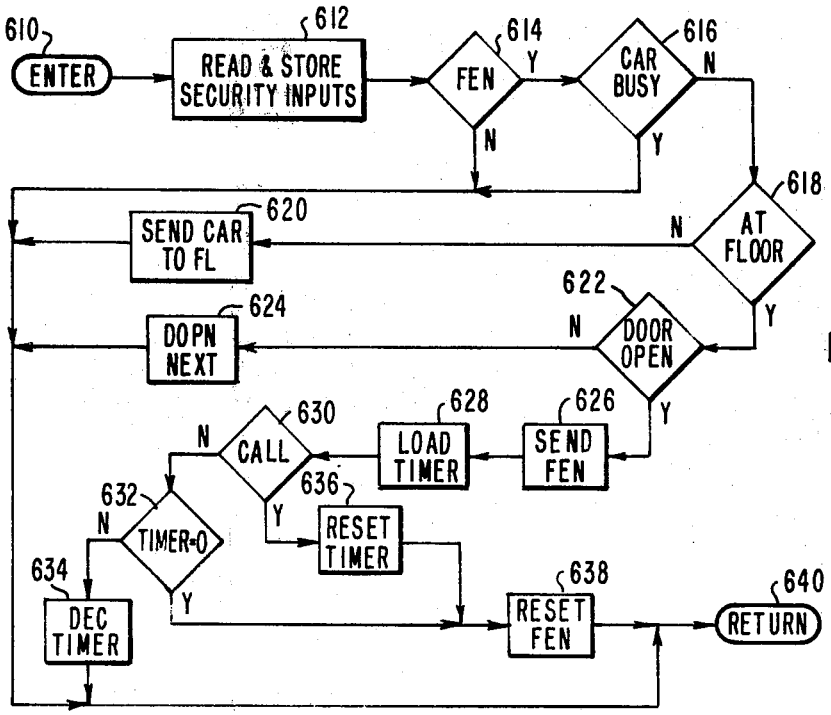
FIG. 4 is a flow chart which illustrates a security program which may be used by the system processor shown in FIG. 1.

FIG. 4 is a flow chart of a program which may be entered by the system processor 512 in response to a security interrupt, and re-entered automatically during each running of the program thereafter until the service requested by the interrupt has been assigned to an elevator car. The program is entered at terminal 610, and step 612 reads and stores the security inputs. Step 614 checks for a true floor enablement signal FEN. If it finds none, the program returns to the main program at exit terminal 640. If a true floor enable signal is detected, step 616 determines if the car, or cars, assigned to handle security calls is busy. If so, the program is exited at terminal 640. If a car enabled for such duty is found which is not busy, step 618 checks to see if it is at the floor of the security terminal. If not, step 620 prepares the necessary assignment words to cause the elevator car to travel to the security floor and open its doors. The system processor can make this the next car to leave the security floor by sending it the signal NEXT. When step 618 finds the car is already located at the security floor, step 622 checks to see if the car doors are open. If not, step 624 gives the door open command DOPN, and also makes the car next by issuing the NEXT command. When the doors of the car open, the availability signal AVAS goes low, but the high NEXT signal will retain a certain enablement function, as will be hereinafter described. When step 622 finds the doors open, step 626 enters the proper floor enable signal into data link LC8 and sends it to the selected car. Step 628 loads a software timer with a value selected to enable the prospective passenger sufficient time to leave the security input user terminal, enter the elevator car and place a car call. Step 630 checks to see if a car call has been placed. If not, step 632 checks to see if the timer value has been decremented to zero. If not, step 634 decrements the timer and returns to the main program. If the car call for an enabled floor is timely placed, step 630 will advance to step 636 which zeroes the timer, and step 638 resets the initial floor enable request and the program returns to the main program at terminal 640. If a call is not timely placed, the timer will time out and step 632 will advance to step 638, which resets the floor enable request. Thus, once a call for a floor is timely placed, it will be noted that the system processor is relieved of any further monitoring function, and it can process the next security request. The portion of FIG. 1 which makes this possible will now be described.

In step 626, the system processor 512 places the true floor enable, or enables, into the proper basic scan slot, or slots, with the true signal occurring in data link LC8 for the selected car during high speed scan slot 8 of the appropriate basic scan slot. The car controller 504 of the receiving elevator car receives data link LC8 in a receiver 700 shown in FIG. 1, which is part of a multiplexer and control 536, and this data, now referred to as signal TR1, is applied to a shift register 750 in a demultiplexing function 554 which also includes registers 756 and 760. Register 760 provides a serial signal FENS which includes the true floor enable signals. Serial signal FENS is applied to a floor enable memory 650, which, according to the teachings of the invention, will "memorize" the serial floor enable signal FENS if a car call is timely placed, i.e., before the timer loaded by step 628 times out and the true floor enable is reset by the system processor 512. Floor enable memory 650 provides a second serial floor enable signal MFENS which is an image of the signal FENS at the time a car call is placed. The system timing signals S0S-S5S, STC and CSST all shown in FIG. 2, are applied to memory 650 to develop the necessary timing for the second floor enablement signal MFENS. Signal $\overline{\text{NEXT}}$ from register 756 is also applied to memory 650, as are signals AVAS and $\overline{\text{NCL}}$ from the floor selector 508. Signal $\overline{\text{NEXT}}$ is low when the car is designated as the next car to leave the main floor, signal AVAS is high when the car is in-service, sitting at a floor with its doors closed, with no calls and no assignments, such as a PARK assignment, and signal $\overline{\text{NCL}}$ is low when the car has no car calls registered.

Figure 5:
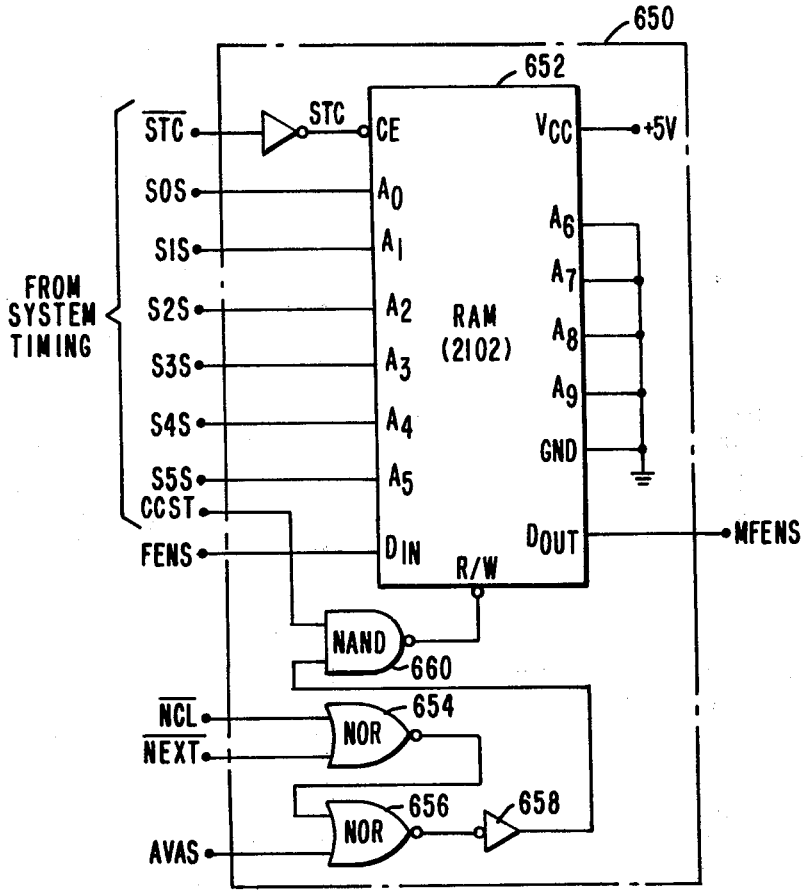
FIG. 5 is a schematic diagram of a memory circuit which may be used for the floor enable memory function shown in block form in FIG. 1.

FIG. 5 is a schematic diagram of a floor enable memory circuit which may be used to provide the memory function 650. The memory function 650 includes a random access memory (RAM) 652, such as National Semiconductor's 1024 word by one bit static memory MM2102. Memory 652 is addressed by counter S0S-S5S, strobe STC is connected to its chip enable input CE to enable a read/write operation during a selected portion of each scan slot, i.e., when STC shown in FIG. 2 is low, its data input $D_i$ is connected to receive signal MFENS, and its data output $D_o$ provides the memorized floor enablement signal, referred to as MFENS. The read/write input R/W is selectively enabled by a circuit which includes NOR gates 654 and 656, an inverter gate 658, and a NAND gate 660. Signals $\overline{NCL}$ and $\overline{NEXT}$ are applied to inputs of NOR gate 654. Signal AVAS and the output of NOR gate 654 are applied to inputs of NOR gate 656. The output of NOR gate 656 is inverted by inverter gate 658, and the inverted output applied to one input of NAND gate 660. The other input of NAND gate 660 is connected to receive strobe signal CCST. The output of NAND gate 660 is connected to the read/write input R/W of memory 652. When R/W is low, the contents of memory 652 may be changed, and when it goes high it retains the condition of the memory at this instant, and is uneffected by the change in information applied to $D_i$ thereafter.

Thus, if a car is "available," i.e., sitting at the floor with its doors closed without calls, signal AVAS will be high, the output of NOR gate 656 will be low, and NAND gate 660 will have a high input. Each time signal CCST goes high, the output of NAND gate 660 will go low to enable the "write" operation. This allows the memory to be reset when no floors are enabled. Also, if the car is designated as the next car to leave the main floor, it will be sitting at the main floor with its doors open, and thus sync signal AVAS will be low. If the car is next, signal $\overline{NEXT}$ will be low. If it has no calls, signal $\overline{NCL}$ will be low. Thus, the output of NOR gate 654 will be high, the output of NOR gate 656 will be low, and the output of inverter 658 will be high. Thus, this situation will also enable the "write" function. True or set bits in signal FENS will be stored in memory 652 when terminal R/W is low. If the prospective passenger enters the car and places a call before the timer times out, and thus before the system processor 512 resets the bits, signal AVAS will be low, since the doors are open, and signal $\overline{NCL}$ will high. Thus, the R/W input of memory 652 will go high and retain the information in the memory 652 at the instant the call is placed. If the call is correctly placed for an enabled floor, the elevator system will respond and deliver the passenger directly to the enabled floor. Upon reaching the floor of the call, the car doors will open to discharge the passenger, and when they close, signal AVAS will go high. Since signal FENS will be all zeroes when signal AVAS goes high to enable the "write" function, the set floor enable stored in memory 652 will be reset. The car may be returned to the security floor when it becomes available to await the next security call, or it may be called back after the next security call is placed, as desired.

Figure 6:
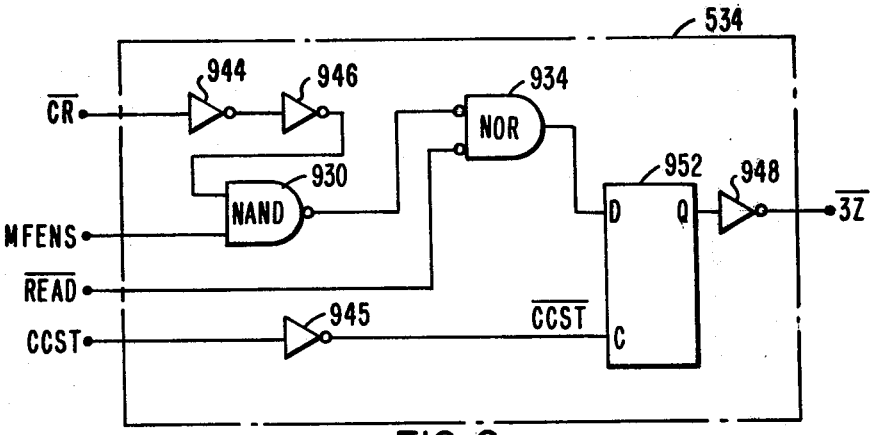
FIG. 6 illustrates car call and reset control which may be used for this function which is shown in block form in FIG. 1.

If the prospective passenger places a car call for a floor which is not enabled, the elevator car will not respond as the car call will be immediately cleared in the car call and reset control 534. FIG. 6 illustrates a car call and reset control which may be used for this function, with FIG. 6 being similar to a portion of FIG. 32 of the incorporated '209 patent. The modification to this circuit merely requires that instead of obtaining car call enable signals FEN from a read only memory track, which is set when the car is initially placed in operation to determine which floors the car may service, the second enablement signal MFENS provides these enables.

Control 534 shown in FIG. 6 includes a NAND gate 930, a NOR gate 934, inverter gates 944, 945, 946 and 948, and a D-type flip-flop 952. Serial car call signals $\overline{READ}$ from control 530 are applied to an input of NOR gate 934. The other input to NOR gate 934 is an enable for the gate responsive to the car call reset signal $\overline{CR}$ and the second enablement signal MFENS. The car call reset signal $\overline{CR}$ is applied to an input of NAND gate 930 via inverters 944 and 946, and the enable signal MFENS is applied to another input of NAND gate 930. If the time slot, and thus the associated floor, is enabled by a high signal MFENS, and there is no car call reset for this time slot ($\overline{CR}=1$), the output of NAND gate 930 will be low, enabling NOR gate 934. If there is a car call for this time slot (floor), signal $\overline{READ}$ will be low, and NOR gate 934 will output a logic one to the D input of flip-flop 952. D-type flip-flop 952 transfers a signal appearing at its D input to its Q output on the positive edge of the clock pulse applied to its clock input C. The clock pulse is the car call strobe signal $\overline{CCST}$. When $\overline{CCST}$ is on its positive going leg, flip-flop 952 is actuated, driving its Q output high and providing a true car call $\overline{3Z}$ via inverter 948.

In summary, there has been disclosed a new and improved elevator system which includes security means at at least one of the floors for recognizing security inputs by prospective passengers. Upon recognizing a proper security input, the security means communicates the floor, or floors, to be enabled, to the system processor of the elevator system. The only supervisory burden on the system processor related to the security function is for the system processor to provide a first floor enabling signal for a selected car which persists for a predetermined period of time. This predetermined period of time is selected to be sufficient to enable the prospective passenger to register a car call in the selected car. A random access memory associated with the selected car provides a second floor enabling signal, which in effect is a memorization or an image of the first floor enablement signal, if the car call is timely placed. A timely placement of the car call involves placing the car call before the system processor resets the specific floor enable, or enables, being generated in response to the security input. If the car call is for an enabled floor, the car will respond. The second enablement signal is automatically retained, without any supervision being required on the part of the system processor, until the car call is served. Once the car call is served, the second enablement signal is automatically reset when the car door is closed following discharge of the passenger. The closing of the car doors following discharge of the passenger is a suitable completion signal signifying that the requested service has been completed and that the car is again available for assignment.

I claim as my invention:

1. An elevator system, comprising:

a building having a plurality of floors, at least one elevator car having car call means, said at least one elevator car being mounted in said building to serve the floors therein, security means at at least one of the floors for recognizing predetermined security inputs, enabling means providing a floor enabling signal for a predetermined floor, with said floor enabling signal persisting for a predetermined period of time sufficient to enable a call to be registered via the car call means, in response to the recognition of a security input by said security means, memory means responsive to a car call for the enabled floor within the predetermined period of time for providing a second enabling signal for the enabled floor, and control means responsive to the second enabling signal and to the car call for causing the elevator car to serve the car call and to provide a completion signal when the service has been completed, said memory means terminating the second enablement signal in response to said completion signal.

2. The elevator system of claim 1 including a plurality of elevator cars, and group supervisory means for controlling said plurality of elevator cars, with the enabling means being included in said group supervisory means, and with each elevator car which is to have the capability of serving car calls in response to security inputs having memory means and control means similar to the memory means and control means of the at least one elevator car.

3. The elevator system of claim 1 wherein the at least one elevator car includes doors operable to open and close an entranceway into the car, with the control means providing the completion signal in response to the at least one elevator car having no car calls registered on the car call means and the doors have been operated to a position which closes the entranceway.

4. The elevator system of claim 1 including timing means providing timing signals which repetitively divide a predetermined period of time into a plurality of scan slots, with each floor of the building being associated with a different scan slot, and wherein the first and second enabling signals are serial signals, with the enabling means and memory means providing a set bit during the scan slot of each predetermined period of time associated with the enabled floor.

5. The elevator system of claim 4 wherein the memory means is a random access memory having address inputs, a data input, a data output, and a read/write input, said memory means being addressed by the timing signals of the timing means, with the read/write input being responsive to a car call being registered and to the completion signal, such that the write function is enabled by the completion signal and is disabled by a car call, and wherein the first enablement signal is applied to its data input, with its data output providing the second enablement signal, said second enablement signal having a bit set therein corresponding to a set bit in the first enablement signal when the write function is disabled by a car call while a set bit is present in the first enabling signal.

6. An elevator system, comprising:

a building having a plurality of floors, at least one elevator car having car call means, said at least one elevator car being mounted in said building to serve the floors therein, security means at at least one of the floors for recognizing predetermined security inputs, enabling means for providing, and for setting and resetting, a first enablement signal, said enabling means setting said first enablement signal in response to the recognition of a security input by said security means, said set first enablement signal enabling a car call to be placed via said car call means for the enabled floor identified by the specific security input, said enabling means resetting said first enablement signal after a predetermined period of time, memory means for providing, and for setting and resetting, a second enablement signal, said memory means being responsive to a car call being placed via said car call means while said first enablement signal is set, for setting said second enablement signal for the enabled floor, and control means for causing at least one elevator car to serve the floor enabled by the set second enablement signal, and to provide a completion signal when such service has been completed, said memory means resetting the second enablement signal in response to said completion signal.

7. The elevator system of claim 6 wherein the predetermined period of time is sufficient only to permit the registration of a car call on the car call means, and is insufficient to permit the at least one elevator car to serve a car call.

8. The elevator system of claim 6 including a plurality of elevator cars, and group supervisory means for controlling said plurality of elevator cars, with the enabling means being included in said group supervisory means, and with each elevator car which is to have the capability of serving car calls in response to security inputs having memory means and control means similar to the memory means and control means of the at least one elevator car.

9. The elevator system of claim 6 wherein the at least one elevator car includes doors operable to open and close an entranceway into the car, with the control means providing the completion signal in response to the at least one elevator car having no car calls registered on the car call means and the doors have been operated to a position which closes the entranceway.

10. The elevator system of claim 6 including timing means providing timing signals which repetitively divide a predetermined period of time into a plurality of scan slots, with each floor of the building being associated with a different scan slot, and wherein the first and second enabling signals are serial signals, with the enabling means and the memory means setting the first and second enabling signals, respectively, by providing a set bit during the scan slot of each predetermined period of time associated with the enabled floor.

11. The elevator system of claim 10 wherein the memory means is a random access memory having address inputs, a data input, a data output, and a read/write input, said memory means being addressed by the timing signals of the timing means, with the read/write input being responsive to a car call being registered and to the completion signal, such that the write function is enabled by the completion signal and is disabled by a car call, and wherein the first enablement signal is applied to its data input, with its data output providing the second enablement signal, said second enablement signal having a bit set therein corresponding to a set bit in the first enablement signal when the write function is disabled by a car call while a set bit is present in the first enabling signal.

* * * * *